US012797683B2

(12) United States Patent
Ribeiro et al.

(10) Patent No.: US 12,797,683 B2
(45) Date of Patent: Nov. 17, 2026

(54) TRAJECTORY GUIDANCE FOR SPORTS PROJECTILES

(71) Applicants: Guilherme Quilelli Corrêa Rocha Ribeiro, London (GB); Rodrigo Quilelli Corrêa Rocha Ribeiro, London (GB)

(72) Inventors: Guilherme Quilelli Corrêa Rocha Ribeiro, London (GB); Rodrigo Quilelli Corrêa Rocha Ribeiro, London (GB)

( * ) Notice: Subject to any disclaimer, the term of this patent is extended or adjusted under 35 U.S.C. 154(b) by 269 days.

(21) Appl. No.: 18/276,612

(22) PCT Filed: Feb. 11, 2022

(86) PCT No.: PCT/GB2022/050372
§ 371 (c)(1),
(2) Date: Aug. 9, 2023

(87) PCT Pub. No.: WO2022/172020
PCT Pub. Date: Aug. 18, 2022

(65) Prior Publication Data

US 2024/0299805 A1 Sep. 12, 2024

(30) Foreign Application Priority Data

Feb. 12, 2021 (GB) ..... 2102007

(51) Int. Cl.
*A63B 102/32* (2015.01)
*A63B 24/00* (2006.01)
(Continued)

(52) U.S. Cl.
CPC ..... *A63B 24/0021* (2013.01); *A63B 57/00* (2013.01); *A63B 71/0622* (2013.01);
(Continued)

(58) Field of Classification Search
CPC . A63B 24/0021; A63B 57/00; A63B 71/0622; A63B 2024/0056;
(Continued)

(56) References Cited

U.S. PATENT DOCUMENTS 5,364,093 A 11/1994 Huston et al.
8,529,380 B1 9/2013 Hubenthal et al.
(Continued)

FOREIGN PATENT DOCUMENTS

CA 2134737 A1 5/1996
CA 2291824 C 4/2004
(Continued)

OTHER PUBLICATIONS

Bearman, P. W. & Harvey, J. K., 1976. Golf Ball Aerodynamics. Aeronautical Quarterly, 27(2), pp. 112-122.
(Continued)

*Primary Examiner* — Michael C Grant
(74) *Attorney, Agent, or Firm* — Conley Rose, P.C.

(57) ABSTRACT

An apparatus comprising means for: obtaining information indicative of a local environmental (e.g., atmospheric) condition; predicting a trajectory of a sports projectile in dependence on information including the information indicative of the local environmental condition; and causing, at least in part, rendering of guidance to a user based on the predicted trajectory.

16 Claims, 6 Drawing Sheets

(51) Int. Cl.
*A63B 57/00* (2015.01)
*A63B 71/06* (2006.01)

(52) U.S. Cl.
CPC ... *A63B 2024/0056* (2013.01); *A63B 2102/32* (2015.10); *A63B 2220/72* (2013.01); *A63B 2220/74* (2013.01); *A63B 2220/75* (2013.01); *A63B 2220/76* (2013.01)

(58) Field of Classification Search
CPC ..... A63B 2102/32; A63B 2220/72; A63B 2220/74; A63B 2220/75; A63B 2220/76; A63B 69/36; A63B 71/0619; A63B 2024/0028; G09B 19/0038; G01P 5/02
USPC ..... 473/131
See application file for complete search history.

(56) References Cited

U.S. PATENT DOCUMENTS

| | | | |
|---|---|---|---|
| 9,421,440 | B1 | 8/2016 | Chau |
| 2003/0103001 | A1 | 6/2003 | Huston et al. |
| 2011/0237358 | A1 | 9/2011 | Carpenter |
| 2015/0126308 | A1 | 5/2015 | Penn et al. |
| 2020/0164258 | A1 | 5/2020 | Tuxen |
| 2020/0269117 | A1 | 8/2020 | Mallory |

FOREIGN PATENT DOCUMENTS

| | | | |
|---|---|---|---|
| CN | 109115275 | B | 9/2020 |
| JP | 2015077286 | A | 4/2015 |
| JP | 2017148412 | A | 8/2017 |
| KR | 101821095 | B1 | 1/2018 |
| KR | 20190096572 | A | 8/2019 |
| WO | 03034088 | A2 | 4/2003 |
| WO | 2005118082 | A1 | 12/2005 |
| WO | 2009150504 | A1 | 12/2009 |

OTHER PUBLICATIONS

Golf Expert Consulting, 2014. Golf Ball Trajectory Model. [Online] Available at: http://www.golfexpertconsulting.com/trajectory-golf-ball-model.htm.

International Application No. PCT/GB2022/050372, International Search Report and Written Opinion mailed Jun. 3, 2022, 11 pages.

MacDonald, W. M. & Hanzely, S., 1991. The physics of the drive in golf. American Journal of Physics, 59(3), pp. 213-218.

United Kingdom Patent Application No. GB2102007.8, Search Report mailed Oct. 22, 2021, 3 pages.

Yalcin, A. & Kaw, A., 2012. Golden Section Search Method. [Online] Available at: https://mathforcollege.com/nm/mws/gen/09opt/mws_gen_opt_txt_goldensearch.pdf.

TRAJECTORY GUIDANCE FOR SPORTS PROJECTILES

CROSS-REFERENCE TO RELATED APPLICATIONS

This application is a national stage filing of International Application No. PCT/GB2022/050372, filed Feb. 11, 2022, which claims priority to United Kingdom Application No. 2102007.8 filed Feb. 12, 2021. The entire disclosures of the afore-mentioned patent applications are incorporated herein by reference.

TECHNOLOGICAL FIELD

Embodiments of the present disclosure relate to wind-dependent trajectory guidance for sports projectiles. Some relate to wind-dependent trajectory guidance for golf balls.

BACKGROUND

Outdoor projectile-based sports such as golf, archery and throwing are exposed to the effects of the local atmospheric conditions and environment. Wind is a critical factor: it can significantly change the trajectory of a shot and thus significantly impact the resulting scores.

Some golf players throw blades of grass up in the air and observe how their surroundings such as trees or a golf flag are moving. The player will then attempt to compensate for the effect of the wind on the estimated trajectory of their shot. Although such wind observations are helpful, these measures only give a general sense of the wind behaviour, making it difficult to accurately compensate for the wind.

If a player brings a wind gauge, the indications displayed by the wind gauge are not much more helpful because wind gauges fail to take into account the intended trajectory, for example, a long-range shot will be deflected more than a short-range shot. Additionally, the wind might affect one player's shot differently than another player's shot.

BRIEF SUMMARY

The invention is as defined in the independent claims.

According to various, but not necessarily all examples there is provided an apparatus comprising a hand-portable wind gauge configured to provide information indicative of a local wind condition, and the apparatus further comprising means for:

obtaining the information indicative of a local wind condition;

predicting a trajectory of a sports projectile in dependence on information including the information indicative of the local wind condition; and causing, at least in part, rendering of guidance to a user based on the predicted trajectory.

In at least some examples, the environmental condition comprises an atmospheric condition. In some examples, the predicted trajectory is dependent on a user and/or a selected sports equipment.

The apparatus can be an electronic apparatus. The apparatus can be a sports projectile trajectory guidance apparatus.

According to various, but not necessarily all examples there is provided an apparatus comprising means for:

obtaining information indicative of a local environmental condition;

predicting a trajectory of a sports projectile or sports vessel in dependence on information including the information indicative of the local environmental condition; and causing, at least in part, rendering of guidance to a user based on the predicted trajectory.

According to various, but not necessarily all examples there is provided a method comprising: obtaining information indicative of a local wind condition from a hand-portable wind gauge;

predicting a trajectory of a sports projectile in dependence on information including the information indicative of the local wind condition; and causing, at least in part, rendering of guidance to a user based on the predicted trajectory.

According to various, but not necessarily all examples there is provided a computer program that, when run on a computer, performs:

causing obtaining of information indicative of a local wind condition from a hand-portable wind gauge;

causing predicting of a trajectory of a sports projectile in dependence on information including the information indicative of the local wind condition; and causing, at least in part, rendering of guidance to a user based on the predicted trajectory.

According to various, but not necessarily all examples there is provided a method comprising:

obtaining base trajectory information for a sports projectile, wherein the base trajectory information is dependent on a characteristic of an indicated sports equipment for launching the sports projectile, wherein the characteristic is a variable, wherein obtaining the base trajectory information comprises determining a launch angle based on the indicated characteristic of the sports equipment, wherein the base trajectory information is further dependent on an indicated user capability, wherein the indicated user capability is a variable, wherein the indicated user capability comprises range associated with a user, and wherein obtaining the base trajectory information comprises determining a launch velocity based on the indicated user capability;

obtaining information indicative of a local environmental condition;

predicting a trajectory of a sports projectile in dependence on information including the information indicative of the local environmental condition, wherein the predicted trajectory is dependent on the base trajectory information; and causing, at least in part, rendering of guidance to a user based on the predicted trajectory, wherein the guidance is dependent on an effect of the local environmental condition on the predicted trajectory. According to various, but not necessarily all examples there is provided an apparatus comprising means for performing the method. According to various, but not necessarily all examples there is provided a computer program that, when run on a computer, performs causing the method.

BRIEF DESCRIPTION

Some examples will now be described with reference to the accompanying drawings in which.

DETAILED DESCRIPTION

Figure 1A:
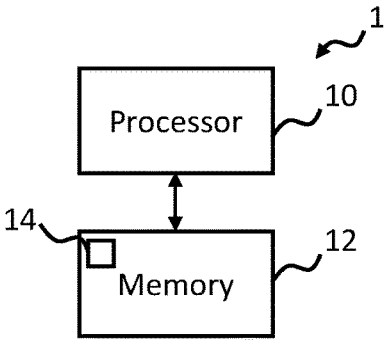
FIGS. 1A, 1B illustrate an example of an apparatus and a non-transitory computer-readable storage medium.

FIG. 1A illustrates an example of an apparatus 1 comprising means for controlling one or more of the methods described herein. The means can comprise a controller (e.g. chipset) comprising at least one processor 10; and at least one memory 12 including computer program code 14, the at least one memory 12 and the computer program code 14 configured to, with the at least one processor 10, cause the apparatus 1 at least to perform at least:

- obtaining information indicative of a local environmental condition;
- predicting a trajectory of a sports projectile in dependence on information including the information indicative of the local environmental condition; and
- causing, at least in part, rendering of guidance to a user based on the predicted trajectory.

Figure 1B:
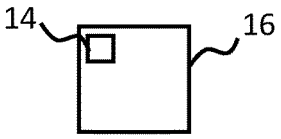

FIG. 1B illustrates a non-transitory computer-readable storage medium 16 comprising the computer program 14.

Figure 2:
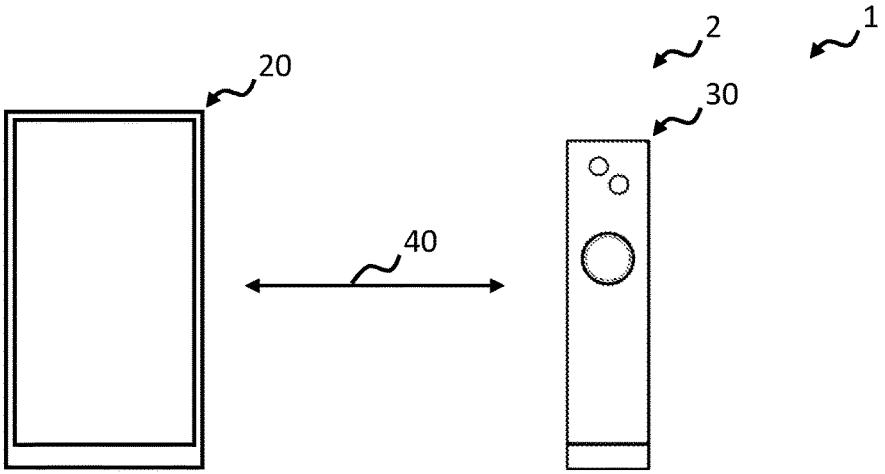
FIG. 2 illustrates an example of apparatus.

FIG. 2 illustrates a non-limiting example in which the apparatus 1 is a system 2 comprising a first device 20 and a second device 30. The above-described means can reside in one or both of the devices 20, 30.

The first device 20 can comprise any suitable device comprising a convenient human-machine interface and/or computational resources. In some, but not necessarily all examples, the first device 20 comprises a hand-portable electronic device such as a smartphone, tablet or laptop. Some methods described herein can be controlled by a software application executable by the first device 20, for example.

The second device 30 can comprise a wind gauge configured to exchange signals 40 with the first device 20, including sending the information ('wind information') indicative of a local wind condition. The wind gauge 30 may be a hand-portable wind gauge.

In another embodiment, all functions reside in the wind gauge 30. In yet another embodiment, the apparatus 1 comprises the first device 20 and not the wind gauge 30.

Figure 3:
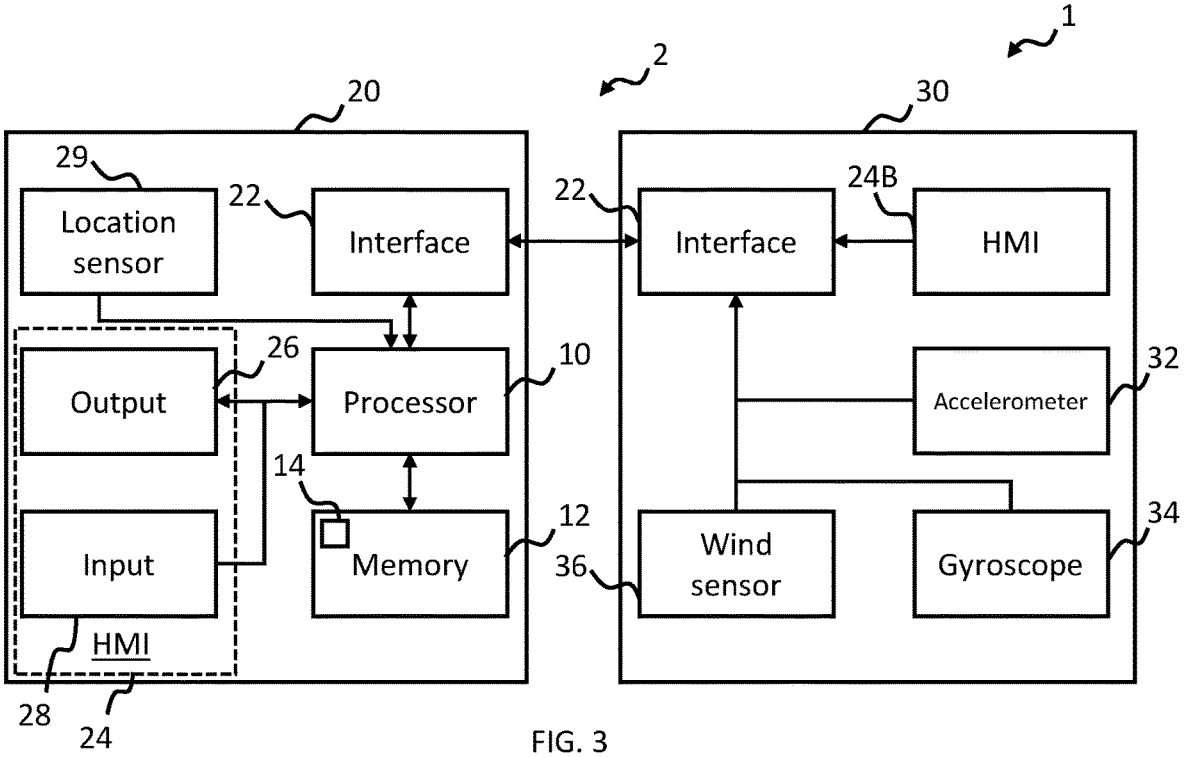
FIG. 3 illustrates an example of apparatus.

FIG. 3 schematically illustrates example functionality of the apparatus 1 of FIG. 2.

In FIG. 3, the first device 20 comprises the controller 10, 12, 14 and a communication interface 22 configured to enable communication with the wind gauge 30.

The communication interface 22 can comprise a wired or wireless interface. The communication interface 22 can comprise a wireless radio interface such as a transmitter, receiver or transceiver. The communication interface 22 can be configured to communicate using a wireless protocol such as a wireless personal area network protocol (e.g. Bluetooth™-based, ZigBee™, etc.), a wireless local area network protocol (e.g. Wi-Fi), or cellular networks (e.g. CDMA, GSM, LTE, etc.).

In some, but not necessarily all examples, the memory 12 of the controller comprises a database to enable determination of one or more of the following parameters: which target the user is aiming; how far the player is from the target; or information indicative of the target's direction from the player. The database may be stored in the local memory 12 of the apparatus 1. Alternatively, the database is remotely stored in a server accessible to the apparatus 1. If the sport is golf, the database can be a golf course database indicating one or more of: hole locations; teeing area locations and/or boundaries; green locations and/or boundaries; rough locations and/or boundaries; or fairway locations and/or boundaries.

The first device 20 can comprise any appropriate human-machine interface (HMI) 24 for enabling control of the functionality described herein. The HMI 24 can comprise one or more input means 28 and one or more output means 26.

An output means 26 (output device) of the HMI 24 can comprise a display configured to render graphical user interfaces, an audio output transducer, a haptic feedback transducer and/or the like.

An input means 28 (input device) of the HMI 24 can comprise a touch sensor, a button, dial or slider, and/or the like. In some examples, the HMI 24 comprises a touch-sensitive display providing input and output functionality.

In some, but not necessarily all examples, the first device 20 can comprise a location sensor 29. The location sensor 29 can comprise a Global Positioning System sensor or similar.

FIG. 3 also schematically illustrates example functionality of the wind gauge 30. The wind gauge 30 comprises a communication interface 22 that is compatible with the communication interface 22 of the first device 20.

The wind gauge 30 can optionally comprise a controller (not shown) in addition to, or instead of the controller of the first device 20.

The wind gauge 30 can comprise one or more sensors including a wind sensor 36. In at least some examples the wind sensor 36 comprises anemometry, specifically adapted to measure wind speed. In some, but not necessarily all examples, the anemometry comprises a hot-wire anemometer because such sensors can be miniaturized and can accurately detect gusts with a short length scale. This enables accurate statistical characterization of local wind conditions, if required.

In other examples, the wind sensor 36 can comprise a different technology such as a mechanical/rotary anemometer, a sonic anemometer or the like.

In some, but not necessarily all examples the wind gauge 30 comprises an orientation sensor configured to enable wind angle (wind direction) to be determined. An example of an orientation sensor is an inertial motion sensor configured to provide direction information to enable the wind angle to be determined. The inertial motion sensor can comprise an accelerometer 32 and/or a gyroscope 34. The inertial motion sensor can be configured as a three-axis, six-axis or nine-axis sensor depending on the required accuracy, resolution and error. Other examples of orientation sensors include magnetic sensors, optical sensors or mechanical sensors. In some, but not necessarily all examples a magnetometer is included with the inertial motion sensor to reduce drift.

The controller can correlate wind information with direction information to determine the direction of the greatest wind speed.

In some, but not necessarily all examples the wind gauge 30 comprises an HMI 24B such as an input (e.g. button) configured to provide functions such as triggering sensing by the one or more sensors when actuated by a user. In other examples, the wind gauge 30 can have a more advanced HMI 24 with features of the HMI 24 of the first device 20 (e.g. touchscreen).

FIGS. 4-12 illustrate a non-limiting example use case to contextualise various functions. This use case relates to golf, but aspects are applicable to other outdoor projectile sports except where such features are incompatible.

As shown in FIGS. 4-12, but not necessarily in all examples, wind information is advantageously combined with user-specific and/or sports equipment-specific information to more accurately predict the trajectory and provide accurate guidance.

Figure 4:
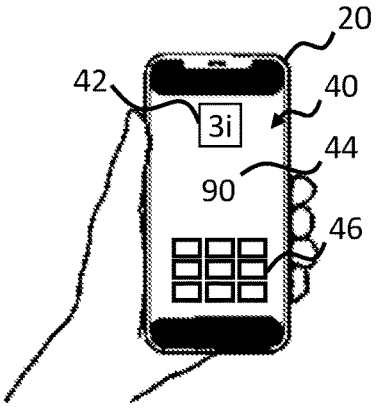
FIG. 4 illustrates an example of a user interface for indicating a user capability.
Figure 6:
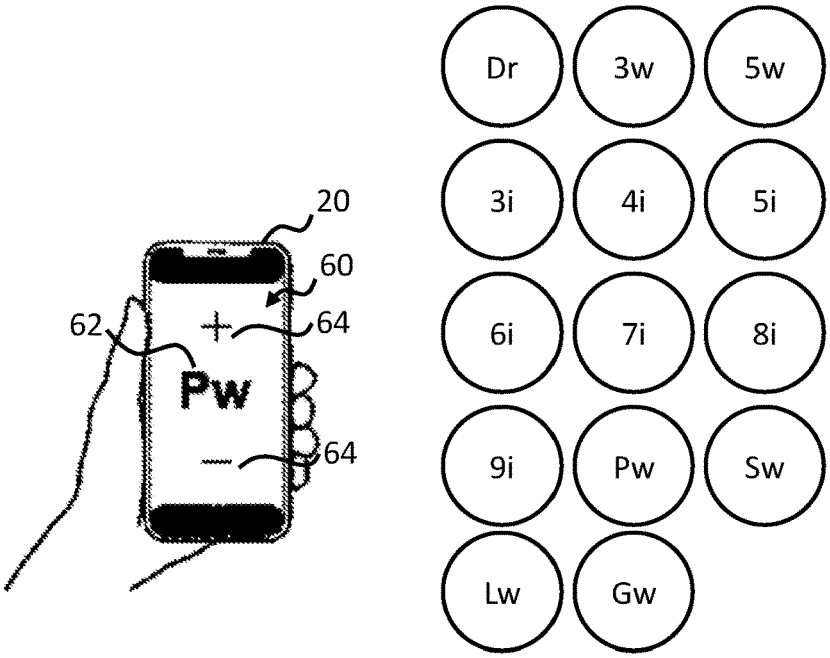
FIG. 6 illustrates an example of a user interface for indicating a sports equipment.
Figure 7:
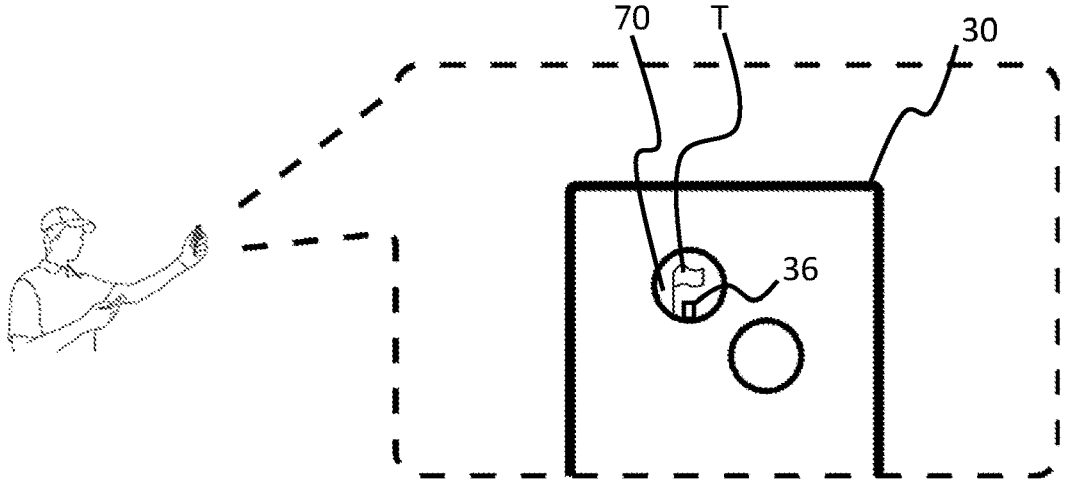
FIG. 7 illustrates an example of pointing a wind gauge at a spatial target.
Figure 8:
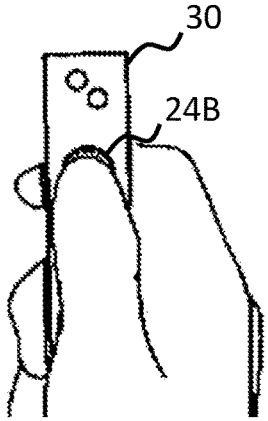
FIG. 8 illustrates an example of triggering wind sensing.
Figure 9:
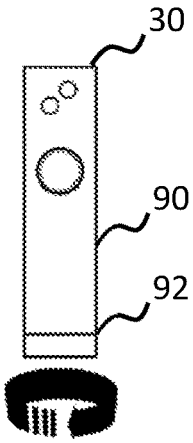
FIG. 9 illustrates an example of enabling sensing of wind angle.
Figure 10:
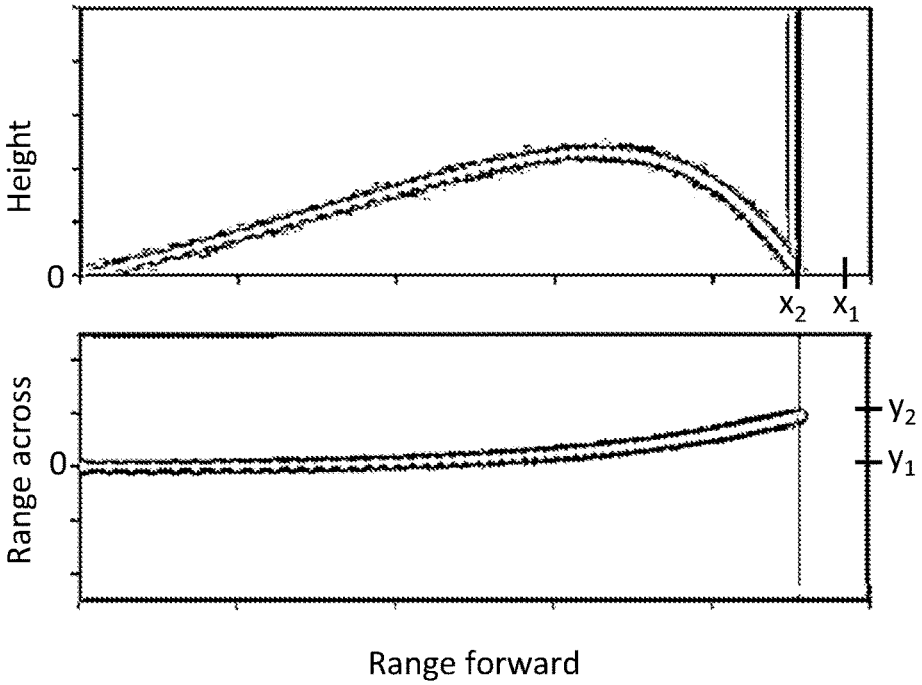
FIG. 10 illustrates an example of a predicted wind-dependent trajectory of a golf ball.
Figure 11A:
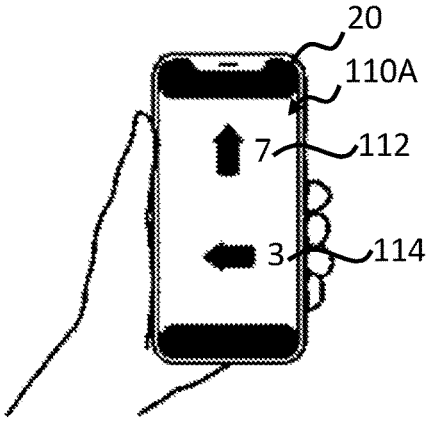
FIGS. 11A, 11B illustrate examples of user interfaces for rendering guidance.
Figure 11B:
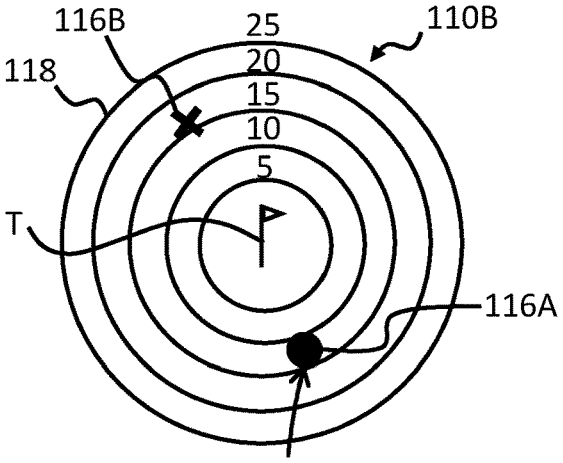

A trajectory can be accurately estimated with knowledge of base trajectory information (e.g. launch angle, launch velocity) and trajectory deviation information (e.g. wind speed, wind angle, assumed/measured spin). The user might not know what the launch angle or velocity are because these can be hard to measure. FIGS. 4 and 6 provide example user interfaces (UIs) 40, 60 for a user to input information that they are likely to know about (e.g. the type of sports equipment they are using, and/or the user's capabilities such as metrics), to enable estimation of base trajectory information. FIGS. 7-9 then show how the wind gauge 30 can be operated to indicate local wind conditions. Spin can be assumed if a measurement is not available. Finally, FIGS. 10, 11A-11B illustrate a predicted trajectory and how guidance may be appropriately presented to the user. The UIs can be controlled by an application running on the apparatus 1.

In summary, prediction of the trajectory can be separated into 1) obtaining base trajectory information (e.g. launch angle and launch velocity) before environmental information such as wind is taken into account, and 2) determining the final predicted trajectory dependent on the information indicative of the local environmental condition (e.g. nominal wind speed and its angle). Details of the prediction are described later.

FIG. 4 provides an example of a UI 40 configured to enable a user to input user-specific information that at least partially enables base trajectory information such as launch velocity to be determined. In this example, the user-specific information indicates a user capability. The user capability can be a variable such as a performance metric.

In the example of golf, a user capability can comprise range associated with the user, that is, how far downrange the user can transmit the projectile. Many golf players spend hours practicing at driving ranges, and are likely to know their range distance. Distances are usually marked at driving ranges, so a user can collect statistical information about their range, such as the average range. For other sports, the variable can be different.

The UI 40 can comprise a graphical user interface (GUI). The UI 40 of FIG. 4 can comprise any appropriate input means 46 such as a physical or rendered numerical keypad or number scroller. In this example, a numerical keypad is rendered on a touchscreen.

The UI 40 can comprise any appropriate output such as a rendered value of the indicated user capability 44. In this example, a range of 90 yards (or metres) is displayed.

The UI 40 can comprise an input (not shown) for selecting between units of measurement may be provided (e.g. metres or yards).

It would be appreciated that the user's capability could alternatively be defined qualitatively such as by a score, or a skill level or the like. The apparatus 1 could convert it to processable quantitative data such as range. Further, the user's capability could be quantified indirectly, for example, based on accelerometer data from a wrist-worn wearable device (e.g., smartwatch, smartband, etc.).

In some, but not necessarily all examples, the UI 40 can enable the indicated user capability to be associated to another variable such as a type of sports equipment having a particular characteristic. In this example, the UI 40 comprises an input 42 enabling selection of a golf club type. In this example use case, the user has selected an iron '3i' and then entered a range, so the entered range is stored as the range for the iron 3i. The UI 40 renders the selected golf club type.

It is advantageous for this association with the sports equipment to be made because a user's range may not necessarily translate to different types of sports equipment for the same sport. For example, different types of golf clubs have different lofts. Loft refers to the angle of the face of the golf club relative to the ground. A low-lofted golf club has a near-vertical face whereas a high-lofted club indicates a high deviation from vertical for giving the golf ball a higher and shorter trajectory. Therefore, a user's range will be dependent on loft. Other characteristics of golf clubs include different shaft lengths and/or weights.

In some examples, different manufacturers have different lofts for the same club type. For example, a 7-iron from one manufacturer can have 28.5 degrees of loft, and a 7-iron from another manufacturer can have 29.5 degrees of loft.

Once the user capability has been indicated, the indication may be stored in local and/or remote non-volatile memory 12 for later retrieval and use in determining base trajectory information, e.g. launch velocity. A specific method 1400 is described later in relation to FIG. 14.

The GUI 40 of FIG. 4 could be rendered by the HMI 24, 24B of one of the devices 20, 30 shown in FIG. 2-3 or by another device.

Figure 5:
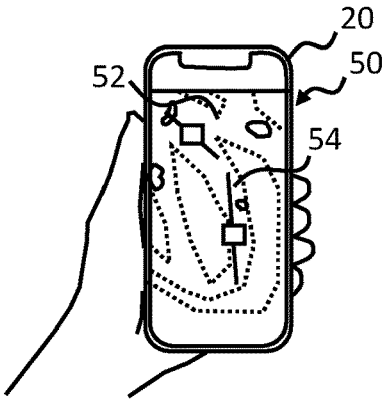
FIG. 5 illustrates an example of a user interface for indicating a range to a spatial target.

When the user visits a golf course or equivalent venue for playing the sport, they may navigate to one or more further UIs such as those shown from FIG. 5 onwards.

FIG. 5 illustrates an optional example UI 50 (e.g. GUI) configured to render an indication 54 of a range to a spatial target such as a golf green or hole/flagged hole or waypoint therebetween. The UI may indicate the range as a distance. This provides the user with useful guidance to help them prepare their shot and select sports equipment with the appropriate characteristic, such as a golf club with a loft appropriate to the required range.

In some examples, if the spatial target is a waypoint, FIG. 5 can concurrently indicate a first range to the waypoint and a second range from the waypoint to the next spatial target (e.g. hole). A chain of two shots is represented in FIG. 5.

In this example, but not necessarily all examples, the range indication 54 in FIG. 5 is overlaid/displayed with a graphical representation 52 (e.g. satellite imagery, geographical information system map, etc.) of one or more of the following location features: a teeing area; a fairway; a rough; a green; a hole. This helps to provide the user with more contextual information.

Information from the location sensor 29 can be used to determine the location of the user to enable the UI 50 of FIG. 5 to be generated. For example, the apparatus 1 may use the user's location to generate a query to a local/remote database such as a golf course database. This enables determination of one or more of the following parameters: which 'hole' the user is playing; how far the player is from the hole; or information indicative of the hole's direction from the player.

The range to the spatial target in FIG. 5 can be from the sensed location of the user according to the location sensor 29 or from a known teeing area location, known from the golf course database.

In some examples, the range to the spatial target can be an input to the trajectory model that is described later. In other embodiments, the trajectory prediction does not need to know about the user's spatial target.

In some examples, the range to the spatial target can be used to enable the apparatus 1 to provide the user with a suggested sports equipment selection (e.g. golf club suggestion). The apparatus 1 can be configured to access stored data associating individual items of sports equipment with individual ranges. The sports equipment with a range closest to the actual range can be suggested, such as via an HMI 24.

The GUI 50 of FIG. 5 could be rendered by the HMI 24 or 24B of one of the devices 20, 30 shown in FIG. 2-3 or by another device.

Once the user has decided their sports equipment (e.g. golf club), the user may then navigate to another UI such as the UI 60 shown in FIG. 6.

The UI 60 (e.g. GUI) is configured to enable the user to input sports equipment-specific information that at least partially enables base trajectory information to be determined. In this example, UI 60 provides an input 64 enabling the user to indicate which sports equipment type they have decided to use.

In the example of golf, a sports equipment type can comprise a golf club type. As described earlier, different golf club types comprise different characteristics such as different lofts. For other sports, the characteristic can be different.

The UI 60 of FIG. 6 can comprise any appropriate input 64 for selecting the sports equipment type, such as a plurality of physical or rendered selectable indicia or a scroller. In this example, the input 64 comprises a scroller with 'plus' and 'minus' indicia for scrolling through golf club types.

The UI 60 comprises an output 62 rendering the currently selected type of sports equipment, which in FIG. 6 is Pw (pitching wedge).

FIG. 6 is accompanied by a key listing fourteen selectable golf club types that a player could have in their bag:

a) Woods such as Dr (one wood/driver), 3w (three wood), 5w (five wood), wherein woods can typically range from one wood to nine wood;

b) Irons including 3i (three iron), 4i (four iron), 5i (five iron), 6i (six iron), 7i (seven iron), 8i (eight iron), 9i (nine iron), wherein irons can typically range from one iron to nine iron;

c) Wedges including Pw (pitching wedge), Sw (sand wedge), Lw (lob wedge), and Gw (gap wedge).

It would be appreciated that any number of golf club types from any number of the above three categories a)-c) can be selectable, and/or golf club types not listed above. A further golf club category not shown above is hybrids, which typically range from 1 hybrid to 9 hybrid. It would be appreciated that there can be more than fourteen selectable types of golf club, although a player will usually carry up to fourteen for a game which is the maximum allowed by rules.

In some examples, once the type of sports equipment has been selected, the apparatus 1 can be configured to obtain the indicated user capability (e.g. range) associated to that type of sports equipment, for example by retrieving the indication from memory 12. For example, if the golf club type Pw is selected, the apparatus 1 may be configured to obtain the user's previously-input range for that golf club type.

If a user capability is missing for the selected type of sports equipment, the apparatus 1 may obtain the user capability for the nearest type of sports equipment for which the user capability is known, or can interpolate or extrapolate from known capabilities for other types of sports equipment. For example, interpolation can be between capabilities for higher loft and lower loft golf clubs. If a range for a 3i club is 180 m and a range for a 5i club is 160 m, then the interpolation can predict a 4i range between those values such as 170 m, for example. Extrapolation can be a continuation of a quantified trend/correlation. Additionally, or alternatively, the apparatus 1 may render a prompt for inputting the missing information.

Before sufficient user capability information is received for the user, the apparatus 1 can utilise default values, such as default ranges, for at least some club types. The default values could be based on a typical player.

In one example, a user can input single representative values to provide their user capability information. In another example, the user can input per-shot data which the apparatus 1 may use to update a statistical metric (e.g. average/median) for the selected sports equipment.

Once the type of golf club has been selected, the loft is known so base trajectory information such as launch angle can be determined. In some examples, trajectory deviation information associated with the selected golf club can be obtained, such as a predetermined (e.g. default) spin value.

In another embodiment, the user directly inputs trajectory model input parameters such as the launch angle, or inputs qualitative information, but selecting a type of golf club as shown is more intuitive for the user.

The GUI of FIG. 6 could be rendered by the HMI 24 or 24B of one of the devices 20, 30 shown in FIG. 2-3 or by another device.

Next, the user may wish to obtain information indicative of a local wind condition. In at least some examples the user has the wind gauge 30 as described in relation to FIGS. 2-3. In other examples, the information can be obtained from user input or from another wind gauge 30 or from a remote server. In some examples, a plurality of wind gauges 30 could be provided at different locations between the user/teeing area.

FIG. 7 illustrates a first step for measuring the local wind condition with the wind gauge 30. The user points the wind gauge 30 in the direction of the spatial target T before starting sensing. This enables an accurate reference direction to be set.

In order to facilitate the accurate pointing of the wind gauge 30 at the spatial target T, the wind gauge 30 may comprise a guide 70 such as a viewfinder. The viewfinder in FIG. 7 can comprise an aperture through a housing of the wind gauge 30, which the user can see through. Once the user can see the spatial target T (e.g. flag) through the viewfinder/aperture 70, the wind gauge 30 is aligned. The anemometry 36 can be located within the aperture 70 so that the anemometry 36 is protectively shrouded and so that the incoming wind is substantially constrained to the direction coaxial with the aperture 70.

In other examples, the viewfinder can be separate from the aperture and/or an aperture is not provided (e.g. unshrouded anemometry).

As shown in FIG. 8, the user may actuate the HMI 24B of the wind gauge 30 (or HMI 24 of the first device 20) to trigger the sensing and/or to set (zero) the reference direction of the wind gauge 30 (if required). The user may still be pointing the wind gauge 30 in the direction shown in FIG. 7.

By setting the reference direction to the direction of the spatial target T, the advantage is that the apparatus is more intuitive to use compared to other reference directions such as compass-north. The user would not be required to find the compass-north every time the apparatus has to be used. Instead, the user would only need to point at the target. It is also more intuitive to the user having the wind frame of reference linked to the target direction than to the Earth's magnetic field.

As shown in FIG. 9, the user may rotate the wind gauge 30, optionally to sweep through 360 circular degrees, while the wind speed and wind gauge orientation are continuously measured (sampled). This enables sensing of the nominal (e.g. maximum) wind speed and angle. A specific method 1300 is described later in relation to FIG. 13.

In the example of FIG. 9, but not necessarily all examples, the device comprises a first, rotatable portion 90 and a second portion 92 configured to be gripped with one hand while the rotatable portion 90 is rotated by the other hand or by other digits of the same hand. The orientation sensor 32, 34 can comprise the gyroscope or another suitable sensor configured to measure the angle with reference to the angle between the rotatable portion 90 and the second portion 92 as the rotatable portion 90 is rotated.

Alternatively, the orientation sensors 32, 34 can enable the user to physically turn around to perform the sweep, while holding the wind gauge 30 steady and without rotating the wind gauge 30 in their hand.

In some examples, the rotation can be slow to obtain time-averaged wind speeds for different orientations, and/or the rotation can be repeated to obtain ensemble-averaged wind speeds for different orientations.

Once the information for predicting the trajectory has been collected, the trajectory prediction can be performed. A specific example is given later in relation to FIG. 15.

FIG. 10 graphically illustrates how the predicted trajectory could look after taking wind, the user and their equipment into account. The user's range for a given launch angle and launch velocity could be $x_1$ and $y_1$ before taking wind into account, and $x_2$ and $y_2$ after taking wind into account. In the example of FIG. 10, $x_2<x_1$ which indicates a headwind, and $y_2$ is left of $y_1$ which indicates a crosswind from the right of the user.

In the above example, $x_1$, $y_1$ can represent the location of a putative spatial target, without knowledge of the location of the actual spatial target (e.g. hole). The putative spatial target indicates where the projectile would first hit the ground (without wind) if the specified user were to launch the projectile with the selected sports equipment type.

In this example, the trajectory model only considers the point of first impact, without modelling subsequent bouncing/rolling behaviour. In another example, the trajectory model further considers subsequent bouncing/rolling behaviour.

Alternatively, $x_1$, $y_1$ could represent the location of an established spatial target. As described in relation to FIG. 5, the identity, distance and/or direction of the hole/waypoint may be known based on a response from the golf course database.

The graph of FIG. 10 may not be the most intuitive way to present the guidance, so the guidance may instead be presented in a more intuitive manner as shown in the UIs 110A, 110B of FIG. 11A or 11B.

The UI 110A (e.g. GUI) of FIG. 11A is configured to provide one or more indications 112, 114 of a direction of required offset needed in order to compensate for the wind to hit the spatial target $x_1$, $y_1$, whereas the UI 110B of FIG. 11B is configured to provide an indication 116 of where the projectile will land so that the user can see the amount of offset required. In some examples, both indications 110A, 110B can be presented.

The UI 110A of FIG. 11A presents the guidance as a lateral offset 114 and a separate range offset 112. Alternatively, a diagonal offset is rendered. In some examples, the direction of the guidance can be presented in dependence on a measured direction (e.g. inertial measurement) of the rendering device (e.g. first device 20). When rotating the device 20 (e.g. direction faced by user), the rendered offset indicator (e.g. arrow) could re-align itself to the required offset outputted by the trajectory model.

In the illustrated example, an arrow or similar directional indicator (symbolic or text) indicates the direction of the required offset to compensate for the wind.

The lateral offset 114 can either point/indicate left or right: left to indicate that the shot should be aimed leftwards to compensate for a rightwards crosswind relative to the reference direction; and right to indicate that the shot should be aimed rightwards to compensate for a leftwards crosswind.

The range offset 112 can either point/indicate up or down: up to indicate that the shot should be aimed downrange of the spatial target T to compensate for a headwind; or down to indicate that the shot should be aimed up range of the spatial target T to compensate for a tailwind.

In some examples, the guidance in FIG. 11A can comprise a number or other quantifier to indicate the distance (e.g. metres, yards, etc.) of the offset. FIG. 11A shows that the shot should be aimed seven metres beyond the spatial target T and three metres to the left of the spatial target.

The UI 110B of FIG. 11B provides an indication of the spatial target T and an indication 116A of where the projectile is expected to land if the user aims for the spatial target T, if the user does not compensate for the wind. The indication 116A shows that the projectile will land short and too far to the right. Alternatively, or additionally, an indication 116B may be shown which indicates where the user should aim, instead of the spatial target T, so that the projectile lands at the spatial target T after accounting for wind.

Although a flag is illustrated in FIG. 11B, the spatial target could represent a putative spatial target as described above. The bearing between the projecting landing spot and the spatial target functions as the indicated offset so that the user knows how to compensate their shot. In FIG. 11B, the user should hit a more powerful shot (or choose a longer-range club) and aim it slightly leftwards.

As shown, the UI 110B of FIG. 11B can optionally provide an indication 118 of a spatial offset of how far the projectile will land from the spatial target. The indication 118 may comprise distance markers such as concentric rings centred around the spatial target. The distance markers 118 can be colloquially referred to as dartboard rings or bullseye rings. The distance of each distance marker from the spatial target T can be indicated (e.g. 5 m, 10 m, 15 m, . . . ). Alternatively, the UI 110B may indicate numbers/arrows of a similar type to those shown in the UI 110A, arranged with the other indications (T, 116).

The GUI 110A/110B of FIG. 11A/11B could be rendered by the HMI 24 or 24B of one of the devices 20, 30 shown in FIG. 2-3 or by another device.

Figure 12:
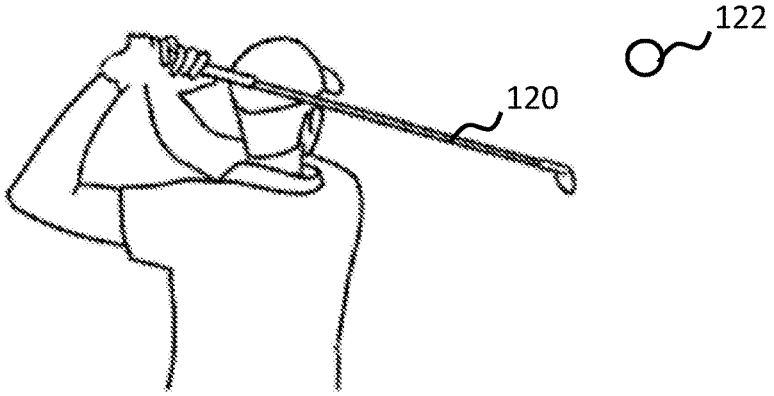
FIG. 12 illustrates an example of a golfer taking a shot.

FIG. 12 then illustrates a golfer taking a shot of a golf ball 122 with their chosen golf club 120, having been through the steps of FIGS. 4-9 in the order described (or a different order). Although the steps could be performed in a different order, it is at least useful if the wind is sensed after the relevant UIs 40, 50, 60 have been used, so the wind knowledge is less out-of-date when the shot is taken. In some examples, if the user attempts to trigger wind sensing before the sports equipment and/or user capability has been selected, the apparatus 1 may not initiate or may discard the wind measurements, and may render a prompt to provide the missing selections. Alternatively, the user may prefer to measure the wind first and then select their sports equipment.

Figure 13:
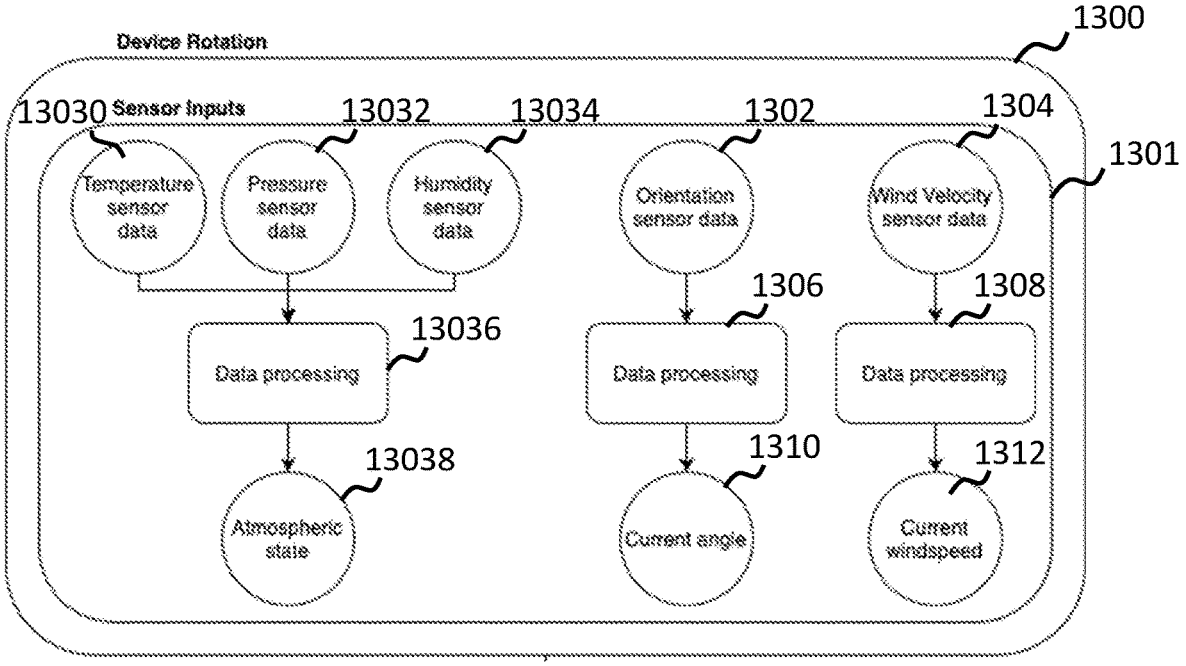
FIG. 13 illustrates an example method of obtaining information indicative of a local wind condition.

FIG. 13 illustrates an example computer-implemented method 1300 for measuring local environmental conditions including wind speed and wind angle. The wind gauge 30 may be moved (e.g. rotated) to enable the measurement.

The method 1300 comprises, at block 1301, obtaining sensor inputs relating to wind gauge orientation and to wind speed.

Obtaining sensor inputs relating to wind gauge orientation can comprise:

- at sub-block 1302, obtaining orientation sensor data such as gyroscope and accelerometer sensor data;
- at sub-block 1306, processing the orientation sensor data to determine the orientation of the wind gauge 30; and
- at sub-block 1310, providing the orientation angle of the wind gauge 30 for later calculations, to enable determination of the prevalent wind direction.

Obtaining sensor inputs relating to wind speed can comprise:

- at sub-block 1304, obtaining wind sensor data, e.g. from a wind sensor 36 of the wind gauge 30;
- at sub-block 1308, processing the wind sensor data to determine the current wind speed; and
- at sub-block 1312, providing the current wind speed for later calculations.

In an example non-limiting implementation, the user actuates the HMI 24, 24B (e.g. scan button) to start the method 1300. The user then rotates the wind gauge 30 so that the wind sensor 36 sweeps a range of directions. Based on the sweep, the greatest measured wind speed may be output as the 'current wind speed', and the orientation of the wind gauge 30 for that greatest measured wind speed may be used to determine the prevalent wind direction. The wind sensor 36 may be semi-directional, to discriminate between wind blowing forwards through the wind sensor 36 and wind blowing in the opposite direction. The prevalent wind direction may correspond to the direction of the wind gauge 30, subtract 180 degrees to obtain the direction from which the wind is blowing.

In some examples, actuating the same or a different HMI 24, 24B during the measurement stops the measurement.

In some, but not necessarily all examples, block 1301 comprises obtaining sensor inputs relating to local environmental conditions other than wind, comprising:

- at sub-block 13030, obtaining temperature data indicative of a local atmospheric temperature, for example, from a temperature sensor of the apparatus 1 or from a weather server lookup based on the sensed location of the user; and/or
- at sub-block 13032, obtaining pressure data indicative of a local atmospheric pressure, for example, from a pressure sensor of the apparatus 1 or from a weather server lookup; and/or
- at sub-block 13034, obtaining humidity data indicative of a local atmospheric humidity, for example, from a humidity sensor of the apparatus 1 or from a weather server lookup;
- at sub-block 13036, processing the temperature/pressure/humidity data to determine local atmospheric state information; and
- at sub-block 13038, providing the local atmospheric state information for later calculations. The information may be treated as scalars rather than vectors, so may be orientation-dependent. However, the measurements may be taken in response to the scan initiation (e.g. via pressing scan button), and therefore during rotation of the wind sensor.

Figure 14:
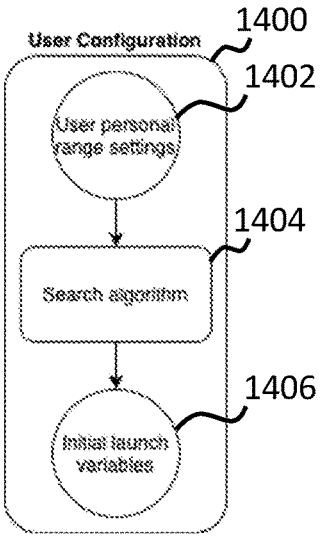
FIG. 14 illustrates an example method of determining a launch velocity.

FIG. 14 illustrates an example computer-implemented method 1400 of determining base trajectory information such as a launch velocity of the sports projectile, based on user-specific and equipment-specific information. The method 1400 can be performed under the control of the apparatus 1. Functions of the method 1400 can be centralized, de-centralized or distributed.

The method 1400 comprises, at block 1402, obtaining the indicated user capability for an indicated (e.g. selected) sports equipment. For example, a golfer's personal club range can be obtained, or a predetermined (e.g. user-overridable default) range for the selected sports equipment could be used. The loft can be obtained based on the indicated sports equipment. In a use case, the range is based on the user input shown in FIG. 4 and the indicated sports equipment is based on the user input shown in FIG. 6. For example, a range of 90 metres for a selected Pw club can be obtained.

The method 1400 then comprises:

- at block 1404, determining one or more initial launch variables, such as launch velocity and launch angle, in dependence on the sports equipment (e.g. default range, loft) and the user capability (e.g. user's range for the selected club); and
- at block 1406, outputting the initial launch variables.

The range may be taken as an average ball distance without wind. Determining the initial launch velocity involves a suitable back-calculation technique. In at least some examples, an optimiser such as a search algorithm is used to perform the back-calculation. An example of a suitable search algorithm is a golden section search algorithm. However, other optimisation and search algorithms could be used. Other algorithms can include gradient methods, global methods, or any other suitable method.

The search algorithm can run a trajectory model multiple times until it identifies a launch velocity matching the user-identified range. Wind may be ignored at this search algorithm stage.

The launch angle can be a predetermined value that is specific to one or more selectable types of sports equipment, as described earlier in relation to FIG. 6. The launch angle and launch velocity provide the base trajectory information for a non-wind corrected trajectory.

In some, but not necessarily all examples, the method 1400 further outputs trajectory deviation information such as spin information relating to a spin of the projectile. This is because spin can affect its trajectory so is therefore an initial launch variable. For golf, the spin information may comprise backspin information and/or sidespin information, which can deviate the golf ball in-flight away from a straight parabolic trajectory. In some examples, the spin information can be a predetermined value that is specific to one or more selectable golf clubs. The trajectory model may process the spin information when determining the trajectory, to more accurately establish the launch velocity.

Spin information can be both user-specific and equipment-specific. A predetermined (e.g. user-overwritable default) value of spin could be determined based on the selected equipment. In some examples, user-specific spin information can be input by the user. The user may know their spin because some driving ranges have sensors which enable estimation of initial launch spin (backspin and/or sidespin). The sensor can be a camera pointing at the ground of a teeing area. The apparatus 1 may be configured to enable the user to input and save the user-specific spin information as a single value for a plurality of selectable golf clubs, and/or as a value specific to individual golf clubs.

The driving range cameras mentioned above may also enable direct measurement of launch velocity and/or launch angle. The apparatus 1 may be configured to enable the user to directly provide the velocity/angle directly, rather than providing their range which would involve assumption-laden back-calculations.

Figure 15:
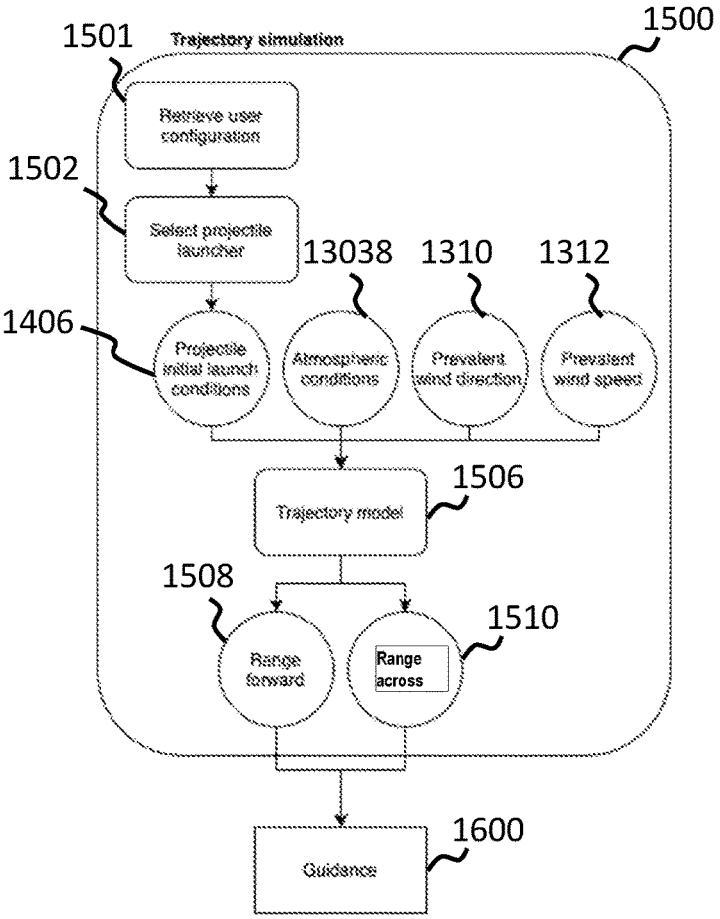
FIG. 15 illustrates an example method of predicting a trajectory and causing, at least in part, rendering of guidance.

FIG. 15 illustrates an example computer-implemented method 1500 of predicting the trajectory of the sports projectile. The method 1500 can be performed under the control of the apparatus 1. Functions of the method 1500 can be centralized, de-centralized or distributed.

The method 1500 comprises, at blocks 1501 and 1502, obtaining an indication of the sports equipment (projectile launcher) to be used. In a use case, the indicated sports equipment is based on the user input shown in FIG. 6. This results in obtaining of the initial launch variables of block 1406 (launch velocity/launch angle/spin).

The method 1500 comprises obtaining local environmental conditions. In FIG. 15, this comprises obtaining the wind speed and the wind direction of blocks 1312 and 1310, respectively, so that the effect of the local wind condition on the predicted trajectory can be quantified. In FIG. 15, this can comprise obtaining the other atmospheric conditions such as temperature/pressure/humidity from block 13038.

The method 1500 then comprises, at block 1506, causing execution of the trajectory model based on the inputs 1310, 1312, 1406, 13038. In some examples the spin information is also used.

In at least some examples, the trajectory model is further tailored for the sport by taking into account projectile-specific calibrations/information such as one or more of: spin, calibrated constants, or experimentally-derived constants for effects like turbulence.

The method 1500 then comprises, at blocks 1508, 1510, providing the outputs of the trajectory model such as at least one spatial offset (e.g. range offset 'range forward', and lateral offset 'range across').

The method 1500 then comprises, at block 1600, causing, at least in part, rendering of the guidance based on the outputs of the trajectory model. In a use case, the guidance can be as described in FIG. 11A and/or FIG. 11B, or a different form of guidance. The guidance can be visual as described, and/or audible and/or haptic.

An example trajectory model for block 1506 is provided below, with optimisations specific to golf balls (e.g. spin, constants). The ball accelerations in the x, y and z directions can be defined as:

$$\frac{d^2x}{dt^2} = -\frac{1}{2}\frac{\rho A}{m}|u|[C_D u_x - C_L(u_y \sin\alpha - u_z \cos\alpha)] \quad \text{Eq. 1}$$

$$\frac{d^2y}{dt^2} = -\frac{1}{2}\frac{\rho A}{m}|u|[C_D u_y + C_L u_x \sin\alpha] \quad \text{Eq. 2}$$

$$\frac{d^2z}{dt^2} = -\frac{1}{2}\frac{\rho A}{m}|u|[C_D u_x - C_L u_x \cos\alpha] - g \quad \text{Eq. 3}$$

Where $u=(u_x, u_y, u_z)$ is the resultant air velocity relative to the golf ball and comprised of its x, y and z components; x is a player-to-flag positive direction; y is a player's right (or left) arm positive direction; z is positive upwards; $C_D$ is drag coefficient; $C_L$ is lift coefficient; a is the angle between the vertical and the axis of rotation and represents the impact of spin on aerodynamic coefficients; g is gravitational acceleration; ρ is air density which could be a variable if the temperature/pressure/humidity was measured; A is the ball frontal area (e.g. circle with regulation size radius of approx. $4.3\times10^{-4}$ m); and m is the mass of the golf ball.

The wind velocity field $v_{wind}=(v_{wind_x}, v_{wind_y}, v_{wind_z})$ can be constantly imposed by subtracting its velocity components from the ball velocity components $v=(v_x, v_y, v_z)$:

$$u_x = v_x - v_{wind_x} \quad \text{Eq. 4}$$

$$u_y = v_y - v_{wind_y} \quad \text{Eq. 5}$$

$$u_z = v_z - v_{wind_z} \quad \text{Eq. 6}$$

Where:

$$v_x = \frac{dx}{dt} \quad \text{Eq. 7}$$

$$v_y = \frac{dy}{dt} \quad \text{Eq. 8}$$

$$v_z = \frac{dz}{dt} \quad \text{Eq. 9}$$

Also:

$$\alpha = \tan^{-1}\left(\frac{\omega_s}{\omega_b}\right) \quad \text{Eq. 10}$$

$$C_L = \frac{\text{constant1}}{|u|} \quad \text{Eq. 11}$$

$$C_d = \frac{\text{constant2}}{|u|} \quad \text{Eq. 12}$$

Where for golf, $\omega_s$ and $\omega_b$ are respectively the sidespin and backspin; constant1 can be approximately 14 and constant2 can be approximately 10. The constants can be different for other similar sports, and different wind models can be used for sports (e.g. Mach effects for bullets, spin-stabilisation for bullets/arrows). Non-dimpled balls may have different constants and spin characteristics. For sports with elongate/fin-guided projectiles such as archery or javelin, spin about one or more axes could be ignored.

The initial ball and wind velocities can be applied in Eq. 13 below, to an iterative function such as a first-order Euler explicit numerical method, a Runge-Kutta method or any other suitable function. Such function can approximate the ball's position, velocity and acceleration at any given time and output a final range as soon as the ball reaches a height of zero.

$$f([v_{wind}], \theta_{wind}, \phi_{wind}, |v_0|, \theta_{launch}, \phi_{launch}) \quad \text{Eq. 13}$$

Where θ is the azimuthal angle relative to the horizontal axis in a spherical coordinate system; ϕ is the polar angle relative to the vertical axis; and $\phi_{wind}$ and $\theta_{launch}$ may be set to zero in the trajectory model. FIG. 10 provides an example of a wind-corrected trajectory computed by Eqs. 1-3.

A coordinate transformation can be employed to change the resultant velocity and angle for both the wind and launch velocities into their Cartesian components. This can be done in the below format:

$$V_{xy} = |V|\cos\phi \quad \text{Eq. 14}$$

$$V_x = V_{xy}\cos\theta \quad \text{Eq. 15}$$

$$V_y = V_{xy}\sin\theta \quad \text{Eq. 16}$$

$$V_z = |V|\sin\phi \quad \text{Eq. 17}$$

Where $v_{xy}$ is the velocity component in the horizontal plane.

The trajectory model can assume the wind velocity field to be constant if only one wind gauge 30 was used, or can integrate measurements from multiple spatially distributed wind gauges to determine a wind velocity field.

The wind velocity field of Eqs. 4-6 is three-dimensional, but in simpler implementations the field could have fewer dimensions such as omitting the z-axis.

The trajectory model can assume turbulent effects to be constants in the model, to avoid the need for a computationally expensive numerical turbulent model.

A variant of the trajectory model can include a variable wind velocity field based on an atmospheric boundary layer approximation such as a log-law model. A variant can take into account temperature, ambient pressure and/or humidity if available from a server or local sensors.

A method 1300, 1400, 1500 can be performed under the control of the apparatus 1. Functions of the method can be centralized, de-centralized or distributed depending on the implementation.

Implementation of a controller may be as controller circuitry. The controller may be implemented in hardware alone, have certain aspects in software including firmware alone or can be a combination of hardware and software (including firmware).

As illustrated in FIG. 1B the controller 1 may be implemented using instructions that enable hardware functionality, for example, by using executable instructions of a computer program 14 in a general-purpose or special-purpose processor 10 that may be stored on a computer readable storage medium (disk, memory, etc.) to be executed by such a processor 10.

The processor 10 is configured to read from and write to the memory 12. The processor 10 may also comprise an output interface via which data and/or commands are output by the processor 10 and an input interface via which data and/or commands are input to the processor 10.

The memory 12 stores a computer program 14 comprising computer program instructions (computer program code) that controls the operation of the apparatus 1 when loaded into the processor 10. The computer program instructions, of the computer program 14, provide the logic and routines that enables the apparatus 1 to perform the methods illustrated in the Figures. The processor 10 by reading the memory 12 is able to load and execute the computer program 14.

As illustrated in FIG. 1B, the computer program 14 may arrive at the apparatus 1 via any suitable delivery mechanism 16. The delivery mechanism 16 may be, for example, a machine readable medium, a computer-readable medium, a non-transitory computer-readable storage medium, a computer program product, a memory device, a record medium such as a Compact Disc Read-Only Memory (CD-ROM) or a Digital Versatile Disc (DVD) or a solid-state memory, an article of manufacture that comprises or tangibly embodies the computer program 14, or the computer program 14 may be, for example, delivered over-the-air (OTA) via a wireless connection or directly via a physical connection (e.g. cable, docking station, etc.). The delivery mechanism may be a signal configured to reliably transfer the computer program 14. The apparatus 1 may propagate or transmit the computer program 14 as a computer data signal.

The computer program instructions may be comprised in a computer program, a non-transitory computer readable medium, a computer program product, a machine readable medium. In some but not necessarily all examples, the computer program instructions may be distributed over more than one computer program.

Although the memory 12 is illustrated as a single component/circuitry it may be implemented as one or more separate components/circuitry some or all of which may be integrated/removable and/or may provide permanent/semi-permanent/dynamic/cached storage.

Although the processor 10 is illustrated as a single component/circuitry it may be implemented as one or more separate components/circuitry some or all of which may be integrated/removable. The processor 10 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The blocks illustrated in the FIGS. 3, 13-15 may represent steps in a method and/or sections of code in the computer program 14. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one" or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims. For example, the local environmental condition can be other than a local wind condition, such as a local temperature/pressure/humidity condition.

Aspects of the disclosure can apply to other sports in which the player aims for a specific target. Examples are given below.

One example sport is marksmanship (e.g. archery, gun shooting sports). The trajectory model can be configured to model the aerodynamic characteristics of the projectile (arrow/bullet). The target can be a static target or a moving target. The target can be a bullseye target, a clay target, a silhouette target or the like. The guidance based on the predicted trajectory can comprise aim correction and/or sight settings.

For shooting, the selectable sports equipment type can comprise a gun type. The gun types can have individual muzzle velocities and/or projectile spins associated to them, for use as input to the trajectory model. The trajectory model can be configured to model the type of projectile that the selected gun type is configured to fire. Aerodynamic characteristics such as projectile shape and/or weight can be taken into account, with wind deviation modelled. The projectile type can be separately selectable or can be automatically determined based on the gun type selection. For shooting, user capability information (range) may be not taken into account because muzzle velocity is generally user-agnostic.

For archery, the selectable sports equipment type may distinguish between different bows and/or different arrows. Different selectable bows can comprise recurve bows, longbows, compound bows and/or crossbows. The selectable bows can have individual arrow velocities and/or sight types associated to them, for use as input to the trajectory model. The trajectory model can be configured to model the type of arrow that the selected bow type is configured to fire. Aerodynamic characteristics such as arrow shape and/or weight and/or spin can be taken into account, with wind deviation modelled. The arrow type can be separately selectable or can be automatically determined based on the bow type selection.

Archery has sights to aid the shot precision. Sight settings provide reference points in the vertical and horizontal axis which allow for calibration for different ranges and wind settings. Launch velocity can be directly estimated and fixed from the type of bow being used (selectable sports equipment) and the draw force chosen (a type of user capability information). This can be carried out by an elastic potential energy to kinetic energy conversion calculation. Arrow choice would affect the projectile mass and aerodynamic properties. Initial shot height could be directly approximated from the user's shoulder height (which could be input by the user) or from further measurements for their own reference shot heights. The initial launch angle can then be back-calculated using a search algorithm relating a particular vertical sight setting to the range achieved. The vertical sight setting and range achieved could be input by the user. After calibrating for different ranges without wind, an estimate for the particular sight setting can then be interpolated according to the range desired. Different sights have different measuring units, which can be taken into account. The above launch angle and launch velocity provide initial conditions for the trajectory model in wind, allowing guidance to be provided under different conditions for the sight setting. The guidance can comprise aim correction (similar to FIGS. 11A-11B for example) and/or recommended sight settings.

Another example sport is sailing. The trajectory of the sports vessel (boat) can be planned rather than the trajectory of a projectile. The trajectory model can be configured to model the hydrodynamic and/or aerodynamic characteristics of the vessel for different wind directions. The target can comprise a buoy or similar marker. The guidance based on the predicted trajectory can comprise recommended sail angle adjustment and/or recommended rudder angle adjustment.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

FIGS. 16A-17B illustrate cross-sections through an example wind gauge 30.

In these FIGURES, but not necessarily all examples, a lower part of the rotatable portion 90 is an inner casing and the second portion 92 is an outer casing. The rotatable portion 90 is within the second portion 92. The outer diameter of the rotatable portion 90 is less than the inner diameter of the second portion 92. The rotatable portion 90 is cylindrical and the second portion 92 is cylindrical. The rotatable portion 90 can therefore rotate within the second portion 92, while the second portion 92 is gripped by a hand. This results in rotation of the wind sensor. A top part of the rotatable portion 90, where the wind sensor resides, protrudes above the top of the second portion 92.

This construction enables the addition of an orientation actuator 1700 for rotating the rotatable portion 90 relative to the second portion 92. This automatic rotation enables more reliable wind measurement than relying upon manual rotation.

The orientation actuator 1700 is housed within the rotatable portion 90 and supported by the rotatable portion 90. The orientation actuator 1700 may comprise a electric motor such as a direct current motor.

The output 1702 of the orientation actuator 1700 is engaged with the second portion 92 in a manner that enables the orientation actuator 1700 to rotate the rotatable portion 90 relative to the second portion 92. The engagement may be via a gear drive mechanism as shown in the cross-section of FIGS. 17A-17B.

As shown, the illustrated gear drive mechanism can comprise an internal gear 1704 within the second portion 92. The output 1702 of the orientation actuator 1700 is a geared wheel that runs around the internal gear 1704 as the output 1702 of the orientation actuator 1700 rotates. This causes the rotatable portion 90 to rotate.

Various electronic components may be housed within the rotatable portion 90. This includes at least the orientation actuator 1700, and circuitry connecting the sensor(s) to the interface 22. The circuitry may be configured to trigger obtaining of the information indicative of a local environmental condition. Further, temperature, pressure, and humidity sensors may be housed within the wind gauge 30 such as within the rotatable portion 90.

Figure 16A:
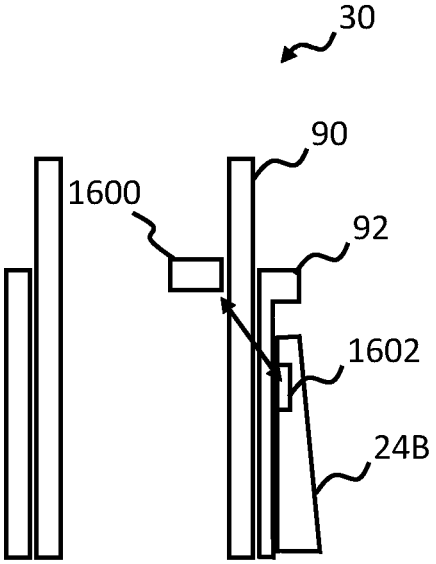
FIGS. 16A, 16B illustrate an example of a wind gauge comprising an input and a non-contact sensor for the input.
Figure 16B:
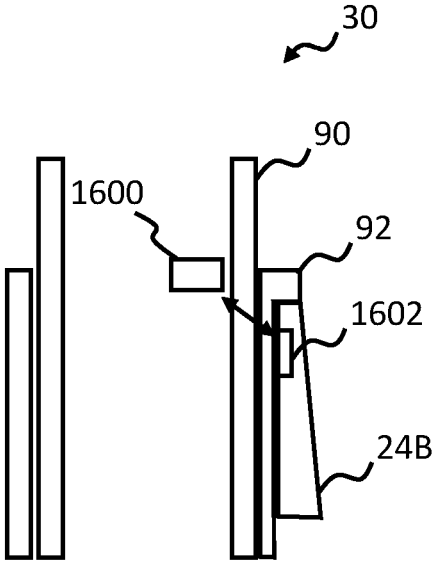
Figure 17A:
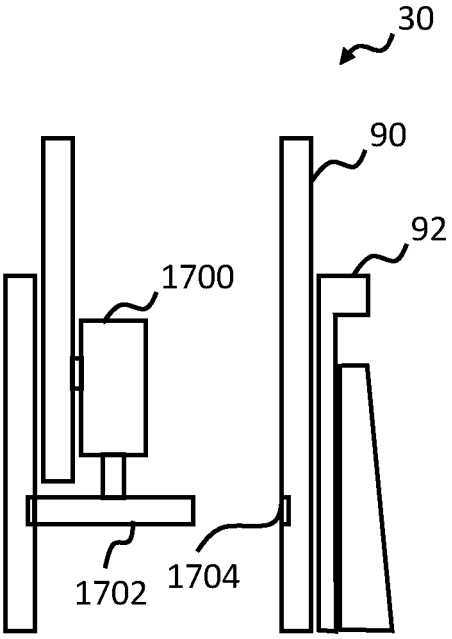
FIGS. 17A, 17B illustrate an example of a wind gauge comprising an orientation actuator.
Figure 17B:
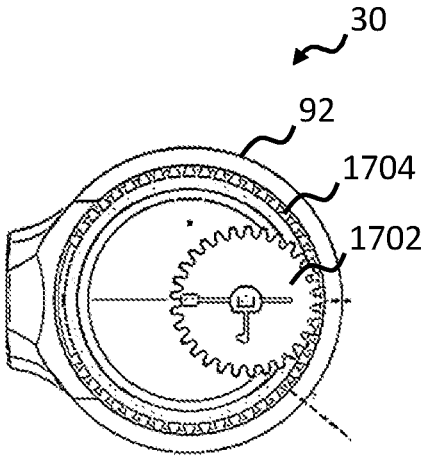

If the wind gauge 30 of FIGS. 16A-17B comprises an input 24B (e.g., sliding button, spring button, other button, trigger, touchscreen button, among other options) for triggering the obtaining of the information indicative of a local environmental condition, the input 24B may be supported by the second portion 92 of the wind gauge 30. In order to operably couple the input 24B to the circuitry housed within the rotatable portion 90, FIGS. 16A-16B illustrate a non-contact sensor 1600 housed within the rotatable portion 90. The use of a non-contact sensor 1600 means that a wired/conductive connection is not required, because a wired connection would inhibit rotation of the rotatable portion 90 relative to the second portion 92. The illustrated non-contact sensor 1600 can comprise a hall effect sensor. The hall effect sensor 1600 may be configured to detect the proximity of a magnet 1602 connected to the input 24B, so that when the input 24B is actuated the magnet 1602 will detectably move towards (or away) from the hall effect sensor 1600. In the illustrated implementation, the hall effect sensor 1600 is connected to the rotatable portion 90 whereas the magnet 1602 is connected to the second portion 92. In an alternative implementation, the magnet 1602 is connected to the second portion 92 and the hall effect sensor 1600 is connected to the rotatable portion 90.

In some examples, the apparatus is configured to initiate device rotation by the orientation actuator 1700 and initiate the obtaining of the information indicative of a local environmental condition, in dependence on the hall effect sensor 1600 stopping detecting (or starting to detect) the magnetic field from the magnet 1602 (when the user slides the input 24B).

In some examples, the controller of the apparatus is configured to control the orientation actuator 1700 to rotate the rotatable portion 90 relative to the second portion 92 from a start angle to an end angle which is the same as or different from the start angle, through one or more intermediate pause angles therebetween. At each intermediate pause angle, the rotation is stopped (or slowed), and the apparatus initiates capture of samples of the information indicative of the local wind condition. In some examples, there are a plurality of intermediate pause angles. In some examples, there are at least three intermediate pause angles. In some examples, the orientation actuator 1700 is set to stop at least four times during a 360 degree rotation (in 90 degree increments or less). Four samples enables an accurate wind direction to be determined. In some examples, the number of intermediate pause angles can be greater to increase accuracy at the expense of a longer scanning time.

In some examples, the orientation sensor of the wind gauge 30 comprises a non-contact sensor. The non-contact sensor may comprise the above-described non-contact sensor 1600, or a different non-contact sensor. In an implementation, a hall effect sensor is connected to the rotatable portion 90 and one or more magnets (e.g., 1602) is/are connected to the second portion 92. Alternatively, the hall effect sensor is connected to the second portion 92 and the magnet(s) is connected to the rotatable portion 90. The hall effect sensor can detect that the rotatable portion 90 has rotated by a known angle in dependence on detecting proximity of a magnet.

In some examples, the orientation actuator 1700 is controlled by an open loop controller to control the rotation of the wind gauge 30, but the orientation sensor 1600 is configured to detect that the rotatable portion 90 has reached the required end angle (e.g., 360 degrees) and cause a controller to stop the orientation actuator 1700 at the end angle.

We claim:

1. An apparatus comprising a hand-portable wind gauge configured to provide information indicative of a local wind condition, and the apparatus further comprising a controller comprising at least one processor, and at least one memory including computer program code, the at least one memory and the computer program code configured to, with the at least one processor, cause the apparatus to perform at least:

obtaining the information indicative of a local wind condition;

predicting a trajectory of a sports projectile in dependence on information including the information indicative of the local wind condition; and causing, at least in part, rendering of guidance to a user based on the predicted trajectory, wherein the hand-portable wind gauge comprises an orientation actuator, a wind sensor, a first rotatable portion comprising the wind sensor, and a second portion able to be gripped with a first hand while the rotatable portion is rotated by the orientation actuator, wherein a top part of the first portion, where the wind sensor resides, protrudes above a top of the second portion, and wherein the orientation actuator comprises an electric motor engaged with the second portion by a drive mechanism, enabling the electric motor to rotate the first portion.

2. The apparatus of claim 1, the at least one memory and the computer program code configured to, with the at least one processor, cause the apparatus to perform at least obtaining base trajectory information for the sports projectile, wherein the base trajectory information comprises at least one variable, wherein the predicted trajectory is dependent on the base trajectory information, and wherein the guidance is dependent on an effect of the local wind condition on the predicted trajectory.

3. The apparatus of claim 2, wherein the base trajectory information is dependent on a characteristic of an indicated sports equipment for launching the sports projectile, wherein the characteristic is a variable.

4. The apparatus of claim 3, wherein the base trajectory information is further dependent on an indicated user capability, wherein the indicated user capability is a variable, wherein obtaining the base trajectory information comprises determining at least one of:

a launch angle based on the characteristic of the indicated sports equipment;

a launch velocity based on the indicated user capability.

5. The apparatus of claim 4, wherein determining the launch velocity in dependence on the indicated user capability is based on a search algorithm.

6. The apparatus of claim 2, wherein the base trajectory information is dependent on an indicated user capability, and wherein the indicated user capability is a variable.

7. The apparatus of claim 6, wherein the indicated user capability comprises a range associated with the user.

8. The apparatus of claim 1, the at least one memory and the computer program code configured to, with the at least one processor, cause the apparatus to perform at least determining a spatial target, wherein the guidance is configured to indicate at least one spatial offset relative to the spatial target, based on an effect of the local wind condition on the predicted trajectory.

9. The apparatus of claim 1, the at least one memory and the computer program code configured to, with the at least one processor, cause the apparatus to perform at least controlling the orientation actuator to rotate the rotatable portion relative to the second portion from a start angle to an end angle which is the same as or different from the start angle, through one or more intermediate pause angles therebetween, and wherein the apparatus is configured to initiate capture of samples of the information indicative of the local wind condition for each of the one or more intermediate pause angles.

10. The apparatus of claim 1, wherein the orientation actuator is supported by the rotatable portion, and wherein an output of the orientation actuator is engaged with the second portion to rotate the rotatable portion relative to the second portion.

11. The apparatus of claim 1, wherein the predicted trajectory is dependent on one or more of: temperature data indicative of a local atmospheric temperature; pressure data indicative of a local atmospheric pressure; or humidity data indicative of a local atmospheric humidity.

12. The apparatus of claim 11, wherein the hand-portable wind gauge comprises one or more of: a temperature sensor configured to obtain the temperature data; a pressure sensor configured to obtain the pressure data; or a humidity sensor configured to obtain the humidity data.

13. The apparatus of claim 1, wherein the hand-portable wind gauge comprises at least one of: anemometry for sensing the information indicative of a local wind condition; or an orientation sensor for enabling wind angle to be determined.

14. The apparatus of claim 13, wherein the orientation sensor comprises a non-contact sensor.

15. The apparatus of claim 1, wherein the apparatus comprises an input configured to trigger sensing of the information indicative of a local wind condition.

16. The apparatus of claim 15, wherein the hand-portable wind gauge comprises the input and comprises a non-contact sensor configured to detect user actuation of the input.

* * * * *